US005699912A

United States Patent [19]

Ishikawa et al.

[11] Patent Number: 5,699,912

[45] Date of Patent: Dec. 23, 1997

[54] CONTAINER FOR WETTED TISSUES

[75] Inventors: Hiroki Ishikawa; Yasuhiko Kenmochi, both of Kagawa-ken; Takeshi Bando, Ehime-ken; Masaho Hayashi; Norikazu Shinogi, both of Tokyo, all of Japan

[73] Assignee: Uni-Charm Corporation, Ehime-ken, Japan

[21] Appl. No.: 745,804

[22] Filed: Nov. 27, 1996

Related U.S. Application Data

[63] Continuation of Ser. No. 663,461, Jun. 14, 1996, abandoned.

[30] Foreign Application Priority Data

Jun. 15, 1995 [JP] Japan ..... HEI7-149092
Feb. 28, 1996 [JP] Japan ..... HEI8-41713

[51] Int. Cl.[6] ..... B65D 73/00

[52] U.S. Cl. ..... 206/494; 220/281; 220/335

[58] Field of Search ..... 206/581, 233, 206/494, 823, 1.5; 220/326, 335, 281, 259, 263, 264

[56] References Cited

U.S. PATENT DOCUMENTS

| | | | |
|---|---|---|---|
| 3,836,044 | 9/1974 | Tilp et al. . | |
| 3,982,659 | 9/1976 | Ross . | |
| 4,101,026 | 7/1978 | Bonk . | |
| 4,185,754 | 1/1980 | Julius . | |
| 4,293,079 | 10/1981 | Lytle | 220/339 X |
| 5,007,555 | 4/1991 | Beck | 220/335 X |
| 5,040,680 | 8/1991 | Wilson et al. | 206/494 X |

FOREIGN PATENT DOCUMENTS

| | | |
|---|---|---|
| 24 48 042 | 4/1975 | Germany . |
| 60-158518 | 10/1985 | Japan . |
| 60-161926 | 10/1985 | Japan . |
| 61-178 | 1/1986 | Japan . |
| 8-217110 | 8/1996 | Japan . |
| 8-217113 | 8/1996 | Japan . |
| 8-253255 | 10/1996 | Japan . |
| WO96/06556 | 3/1996 | WIPO . |

OTHER PUBLICATIONS

Japanese Industrial Standard No. K6301, "Physical Testing Methods for Vulcanized Rubber", Japanese Standards Association: 1995.

Japanese Industrial Standard No. K6758, "Testing Methods for Polypropylenes", Japanese Standards Association: 1981.

*Primary Examiner*—Jacob K. Ackun
*Attorney, Agent, or Firm*—Lowe, Price, LeBlanc & Becker

[57] ABSTRACT

A container for wetted tissues comprises a container body, a stationary lid member and a movable lid member each molded from a suitable synthetic resin material. The stationary lid member fits on the container body to close an upper opening of the container body and the movable lid member is hinged to the stationary lid member so as to cover an opening formed substantially in a central zone of the stationary lid member through which the wetted tissues will be picked out. Any one of an upper surface of the stationary lid member and an inner surface of the movable lid member is provided with an elastic strip fixed across the hinged portion. As the movable lid member is closed, the elastic strip is curved generally in a U-shape or Ω-shape within a space defined between the inner surface of the movable lid member and the upper surface of the stationary lid member and thereby charged with an elastic energy biasing the movable lid member to be opened.

13 Claims, 16 Drawing Sheets

CONTAINER FOR WETTED TISSUES

This application is a continuation of application Ser. No. 08/663,461 filed Jun. 14, 1996 and now abandoned.

BACKGROUND OF THE INVENTION

The present invention relates to a container for wetted tissues and more particularly to such a container having a movable lid member so improved that it can be automatically opened by one-touch operation.

Conventional containers for wetted tissues comprise, for example, a body of the container made of a synthetic resin material constructed so that wetted tissues for cleaning a user's skin can be picked out one by one from a stack of wetted tissues packed therein and a lid made of synthetic resin adapted to fit on the body to cover its upper opening. The lid comprises a stationary lid member directly fitting on the upper opening of the body and a movable lid member having its base end hinged to one side end of an opening formed substantially in a central zone of the stationary lid member through which wetted tissues will be picked out one by one for selectively opening or closing the opening. Between the movable lid member and the stationary lid member, there is provided a snap-locking means by which the movable lid member is snap-locked to the stationary lid lid member is closed and this means may be operated by a user to release the snap-locking.

However, the above-mentioned container of well known has been inconvenient in that the snap-locking can not be released by one-touch operation or if the snap-locking can be released, a user is required to pinch the movable lid member between the user's fingers.

In view of the problem as mentioned above, it is a principal object of the invention to provide a container for wetted tissues constructed so that the movable lid member can be automatically opened.

SUMMARY OF THE INVENTION

According to the invention, there is provided a container for wetted tissues comprising a container body, a stationary lid member and a movable lid member each molded from suitable synthetic resin; wherein:

the container body has a first opening on an upper side thereof through which a stack of wetted tissues is packed thereinto;

the stationary lid member includes an outer locking periphery adapted for detachably and sealably fitting on the first opening, a first upper surface region defined by the outer locking periphery and a first peripheral edge having spaced apart front and rear edges, a second upper surface region defined by the first peripheral edge, and a second opening formed in the second upper surface region substantially at a central zone thereof through which the wetted tissues are picked out;

the movable lid member includes a second peripheral edge projecting from an inner surface thereof so as to fit on the first peripheral edge thereby to define a space between the second upper surface region of the stationary lid member and the inner surface of the movable lid member, having spaced apart front and rear edges and being hinged to the stationary lid member adjacent the rear edge;

an elastic strip made of a nonmetallic material normally biasing the movable lid member to be opened extends across the rear edges of the stationary and movable lid members and held between the second upper surface region and the inner surface of the movable lid member wherein the elastic strip is at least partially curved generally in a U-shape or Ω-shape and charged with an elastic energy within the space as the movable lid member is closed;

at least one of the front edges of the stationary and movable lid members opposed to each other upon closure of the movable lid member includes a locking projection adapted to be detachably engaged with the other; and the first upper surface region is provided adjacent the locking projection with an elastically deformable depressor means serving to release the engagement of the locking projection.

According to the invention, the depression of the depressor means by a user's finger causes at least one of the depressor means and a region in proximity thereof to be elastically deformed and thereby the movable lid member which has been held by the locking projection in its closed state to be easily released whereupon the movable lid member is automatically opened under the elastic force of the elastic strip about the hinged portion. With the movable lid member having been opened in this manner, it is possible to pick out the wetted tissues through the opening of the stationary lid member. After picking out of the wetted tissues, the movable lid member may be closed against the elastic force of the elastic strip to assure that the elastically deformable portion is elastically deformed again and the locking projection comes again in engagement with the portion opposed thereto, i.e., at least one of the front edge of the stationary lid member and the front edge of the movable lid member opposed to each other so as to hold the movable lid member closed.

As the movable lid member is closed, the elastic strip is curved generally in a U-shape or Ω-shape and charged with an elastic energy within the space defined between the stationary lid member and the movable lid member so that the movable lid member can be automatically opened even if the elastic strip itself is made having a relatively low elasticity such as rubber. Effect of the elastic strip to open the movable lid member is made further reliable by, in addition of said energy charging, placement of a working point at which the elastic strip acts upon the movable lid member at a predetermined distance from the hinged portion of the movable lid member toward the front edge of this lid member as adopted in the embodiment of the invention. The elastic strip is curved in a relatively natural shape within the space, so there is no apprehension that the elastic strip might become fatigued due to relatively high frequency at which the movable lid member is opened and closed or closure of the movable lid member lasting for a relatively long period might generate a permanent distortion in the elastic strip and thereby reduce its elastic force. Such advantage is made further effective by defining between the stationary lid member and the movable lid member a recess deeper than the space adapted to receive the elastic strip in its naturally curved state. In addition, according to the embodiment of the invention, the elastic strip can be effectively fixed by fixing one end alone to the movable lid member or the stationary lid member, preferably to the movable lid member, so mounting of the elastic strip is facilitated.

Wile engagement between the stationary lid member and the movable lid member by a means of the locking projection is easily released under the elastic deformation of at least one of the depressor means or the region in the proximity thereof by depressing the depressor means by a user's finger, such engagement between the stationary lid member and the movable lid member can be more easily released by depressing the depressor means by a user's finger by forming the movable lid member from material which is elastically deformed more easily then the material for the stationary lid member and/or forming the depressor means and at least the region surrounding it to be most easily deformed.

The other advantages will be apparent from the following description.

PREFERRED EMBODIMENT OF THE INVENTION

Figure 1:
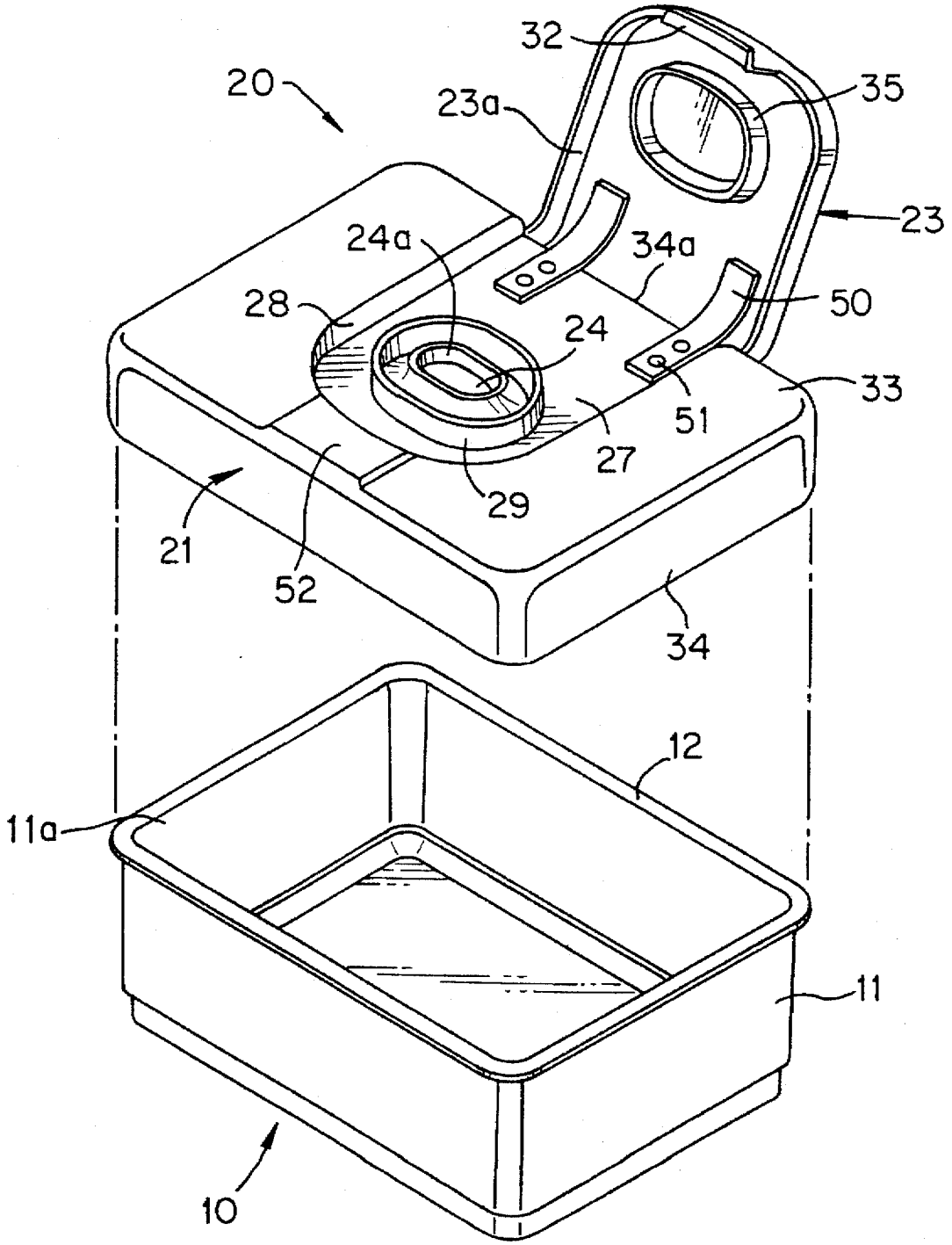
FIG. 1 is a perspective view showing a container for wetted tissues according to the invention as its lid being separated from its body and a movable lid member forming a part of the lid being opened.
Figure 2:
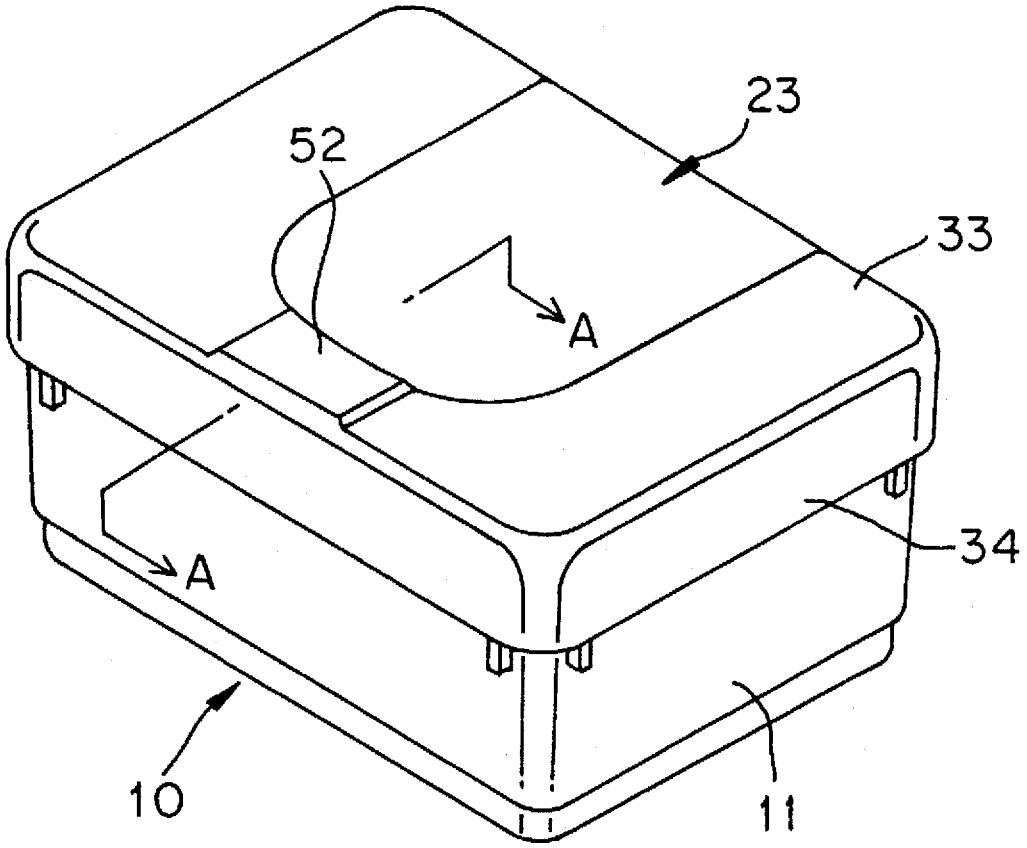
FIG. 2 is a perspective view of the container shown by FIG. 1 as its lid fitting on its body.
Figure 3A:
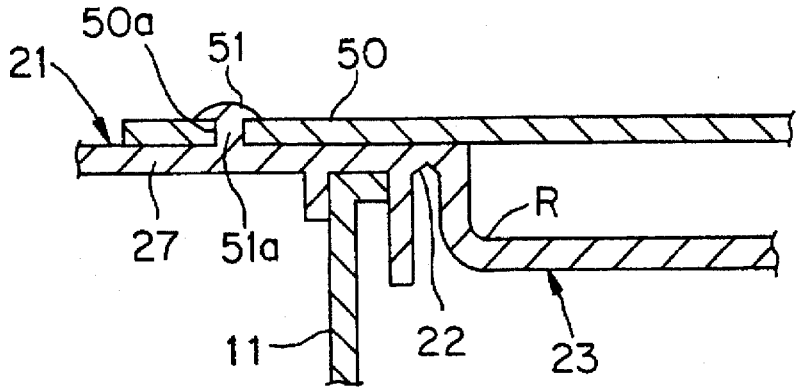
FIG. 3A is a fragmentary sectional the view of the container showing a hinged portion by which the movable lid member is rotatively connected to a stationary lid member also forming a part of the lid as well as a manner in which an elastic strip is fixed to the stationary lid member.
Figure 3B:
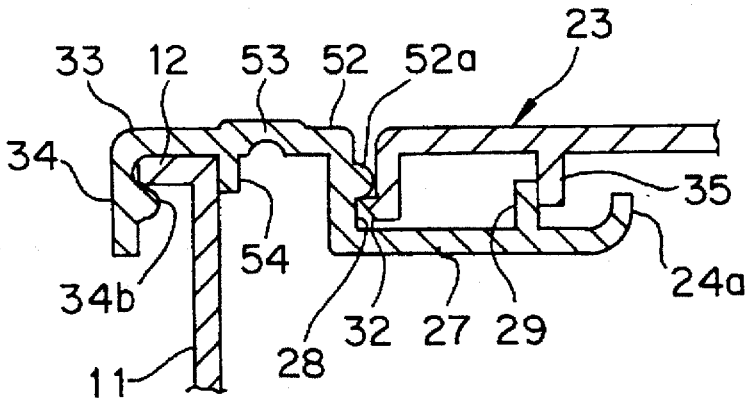
FIG. 3B is a sectional side view taken along a line A—A in FIG. 2, showing a mechanism for locking the movable lid member and stationary lid member together as they have been locked together.
Figure 3C:
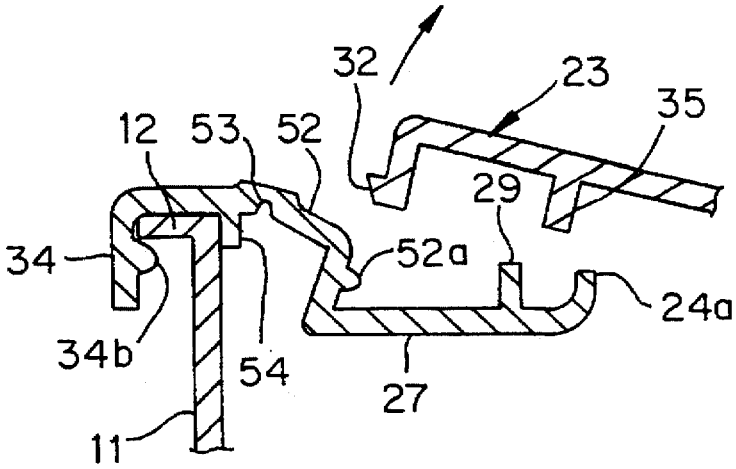
FIG. 3C is a view similar to FIG. 3B, showing the mechanism as the movable and stationary lid members having been unlocked from each other.

Referring to FIGS. 1 through 3, a container 10 comprises a container body 11, an upper opening 11*a* and a flange 12 extending along an outer peripheral edge of the opening 11*a*, and a lid 20 covering the opening 11*a*. The body 11 is made from a suitable synthetic resin material in a generally rectangular parallelepiped and contains therein a stack of wetted tissues as will be described later. The lid 20 comprises a stationary lid member 21 and a movable lid member 23 both made of a suitable synthetic resin material.

The stationary lid member 21 includes an outer locking periphery 34 provided with circumferentially extending projections 34*b*, 54 (FIG. 3B) adapted to be disengageably engaged with the flange 12, a generally U-shaped first upper surface region 33 whose outer border extends along its majority just above the outer locking periphery 34, a second upper surface region 27 defined by a generally U-shaped inner edge 28 of the first upper surface region 33 as well as a stepped surface lower than the region 33 and placed aside toward a rear end 34*a* of the lid 20, an annular wall 29 formed substantially in a central region of the surface region 27 and an opening 24 defined substantially in a central region of the wall 29 by a rising peripheral edge 24*a* which is substantially concentric with the annular wall 29.

The movable lid member 23 has its rear edge integrally connected by a hinged portion 22 to the rear edge 34*a* of the stationary member 21, a peripheral edge 23*a* projecting toward the second upper surface region 27 so as to be engaged with the peripheral edge 28 of the stationary lid member 21, an annular wall 35 formed on an inner surface of the lid member 23 so as to be tightly engaged with the annular wall 29 of the stationary lid member 21, and a locking projection 32 formed on a free end of the movable lid member 23 as will be described later more in detail.

The stationary lid member 31 is molded from a suitable soft polypropylene material and has a modules of bending elasticity preferably of 5,000 to 11,000 kg/cm$^2$, more preferably of 5,200 kg/cm$^2$ as determined according to JIS K675. Suitable materials include, for example, MD 770H supplied from Showa Denko K.K. The movable lid member 23 is molded from a relatively hard polypropylene material and has a modules of bending elasticity preferably of 12,000 to 18,000 kg/cm$^2$, more preferably of 15,300 kg/cm$^2$ as determined according to JIS K6758. Suitable materials should have Melt Flow Rate of 56 g/10 min as determined according to JIS K6758 and include, for example, J-6071 HP supplied from Idemitsu Sekiyukagaku K.K. The stationary lid member 21 as well as the movable lid member 23 may be molded not only from a polypropylene material but also from suitable materials such as polyethylene, polystyrene, acrylonitril butadiene styren, polyester, polyvinile chloride, polycarbonate or elastomer. Obviously, the body 11 may be also molded from any one of the previously mentioned materials.

A pair of elastic strips 50 extend across the rear edges of the stationary lid member 21 and the movable lid member 23 and each of these elastic strips 50 is fixed at its one end by a caulking means 51 to the second upper surface region 27 with a free end of the elastic strips 50 being pressed against the inner surface of the movable lid member 23. Accordingly, the movable lid member 23 is normally biased by the elastic strip 50 to be opened. The caulking means 51 comprises, as will be understood from FIG. 3A, a projection 51*a* formed on the second upper surface region 27, extending through an opening 50*a* formed in one end of each elastic strip 50 and having its upper end deformed under heating treatment into a screw-head shape. It should be understood that the elastic strip 50 may have its fixed end placed on the inner surface of the movable lid member 23 rather than on the inner surface of the stationary lid member 21 and the number of the elastic strips is not limited to one pair so far as the number is plural.

Figure 4A:
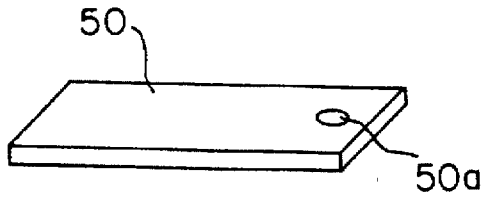
FIGS. 4A through 4F are perspective views exemplarily showing various configurations of the elastic strip.
Figure 4B:
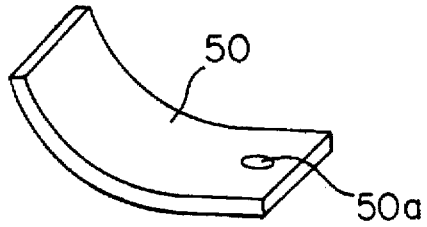
Figure 4C:
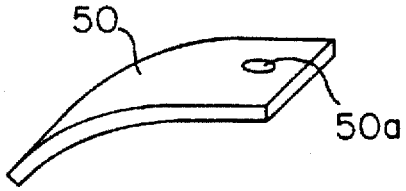
Figure 4D:
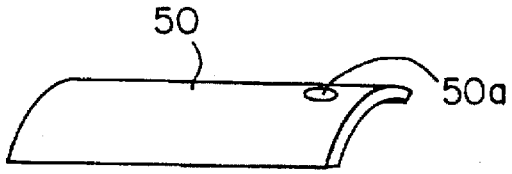
Figure 4E:
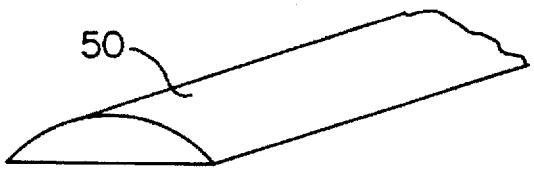
Figure 4F:
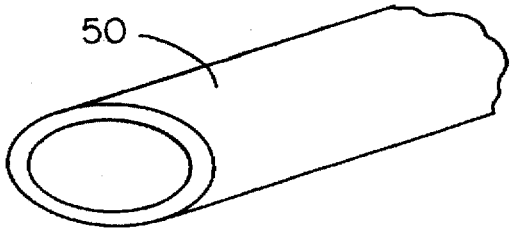

The elastic strip 50 may be molded from rubber or synthetic resin materials having a rubber elasticity such as silicone rubber, chloroprene rubber, butadiene rubber, urethane rubber, ethylene-propylene copolymer or natural rubber, preferably having a hardness of 40° to 70° as determined by the physical test of vulcanizate according to JIS K6301-1975 and a thickness of 1.5 to 3.0 mm. Such elastic strip 50 may be obtained by compression molding, extrusion or injection molding and may have its front and/or rear surface embossed, if desired. The elastic strip 50 may be flat and have a rectangular cross-section as shown by FIG. 4A; longitudinally curved and have a cross-section as shown by FIGS. 4B and 4C; transversely curved and have a rectangular cross-section as shown by FIG. 4D; have a semicircular cross-section as shown by FIG. 4E; or have a circular cross-section as shown by FIG. 4F.

Referring again to FIGS. 1, 2, 3B and 3C, the first upper surface region 33 of the stationary lid member 21 is provided with a depressor means 52 having a thin-walled portion 53 so that the locking projection 32 on the movable lid member 23 is opposed to this depressor means 52 as the movable lid member 23 is closed, and the first peripheral edge 28 of the stationary lid member 21 is provided at a position opposed to the locking projection 23 with a locking projection 52*a* adapted to be disengageably engaged with the locking projection 32. As the movable lid member 23 hold by a user's fingers is pivotablly rotated down about the hinged portion 22 onto the second upper surface region 27 against the elasticity of the elastic strips 50, the locking projection 32 strikes the locking projection 52*a* from above, elastically deforms the depressor means 52 and its proximity until the locking projection 32 can clear the locking projection 52*a* downward, whereupon the elastically deformed portion is restored to its original state and simultaneously the locking projection 32 is snap-engaged with the locking projection 52*a*. When, from such engaged state, a user's finger depresses the depressor means 52 from above,the depressor means 52 and its proximity bordered by the thin-walled portion 53 is elastically deformed so as to release the mutual engagement of the locking projections 32, 52*a*.

As will be understood from FIG. 1, during closure of the movable lid member 23, the elastic strips 50 are maintained to be curved generally in U-shapes, respectively, against their own elasticity within a space defined between the respective inner surfaces of the second upper surface region 27 and the movable lid member 23, i.e., these elastic strips 50 are changed with a sufficient elastic energy to automatically open the movable lid member 23 under the elasticity of the elastic strips 50 as soon as the locking projection 32 is disengaged from the locking projection 52*a* in the manner as has previously been described.

Figure 5:
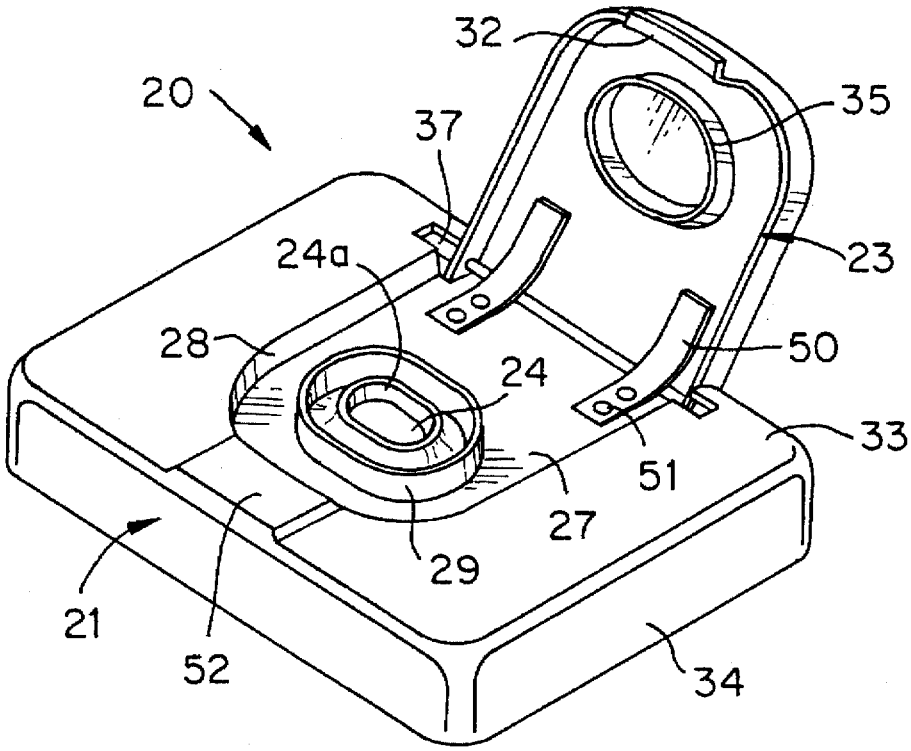
FIG. 5 is a perspective view of the lid, showing an alternative embodiment of the hinged portion by which the movable lid member is rotatively connected to the stationary lid member.

FIG. 5 shows a case in which a hinged portion is provided separately of the stationary lid member 21 as well as the movable lid member 23. According to this embodiment, the movable lid member 23 are molded independently of the stationary lid member 21 so as to be hinged to the stationary lid member 21 by a means of a pivot pin 37. The separate provision of these lid members in this manner is advantageous in that not only the lid 20 can be easily folded but also the hinged portion will be relatively durable.

Figure 6:
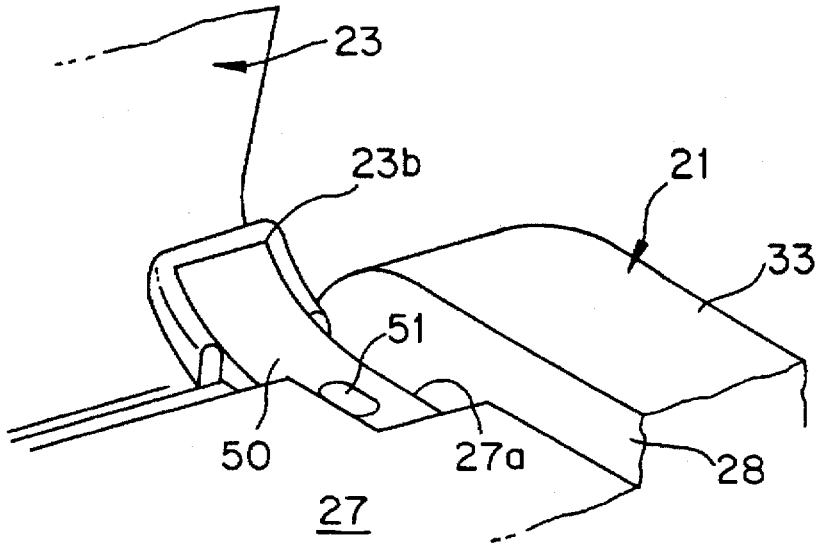
FIG. 6 is a perspective view showing an alternative embodiment of the elastic strip.
Figure 7:
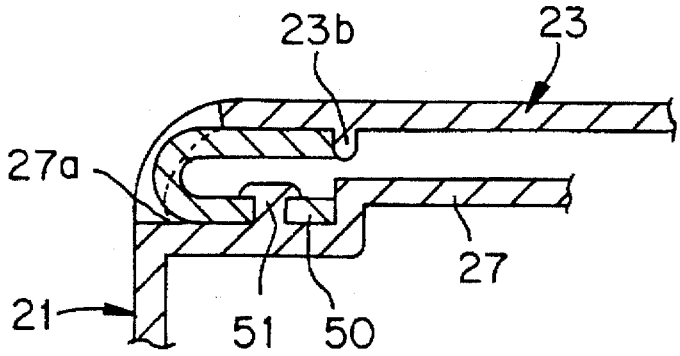
FIG. 7 is a sectional side view showing the elastic strip curved after the movable lid member has been closed.
Figure 8:
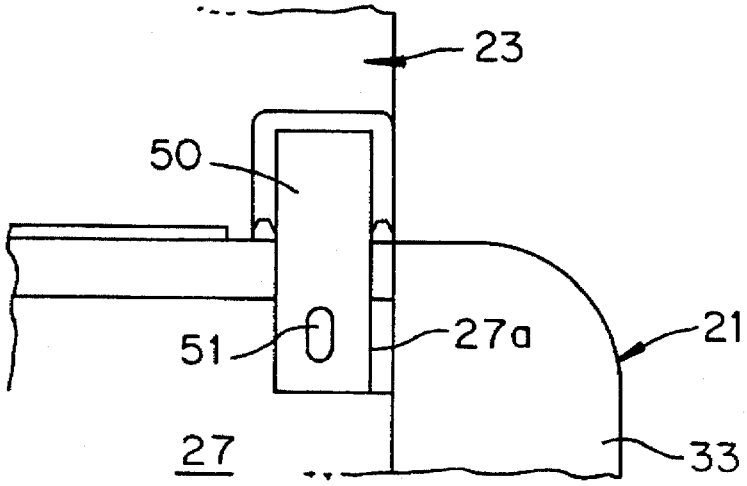
FIG. 8 is a plan view corresponding to FIG. 6.

Referring to FIGS. 6 through 8, an alternative embodiment of the elastic strip 50 is shown, in which a recess 27*a* is formed between the rear edge of the first upper surface region 33 and the rear edge of the second upper surface region 27 and the inner surface of the movable lid member 23 is formed with a generally U-shaped retainer 23*b*. The inner surface of the movable lid member 23 defined by the retainer 23*b* is defined by a radius of curvature selected to provide a gentle curvature and the respective free ends of the elastic strips are pressed against this curved surface. The curved surface defined by such radius provides a space within which the elastic strips 50 can be smoothly curved generally in U-shapes and charged with the desired elastic energy as the movable lid member 23 is closed.

Figure 9A:
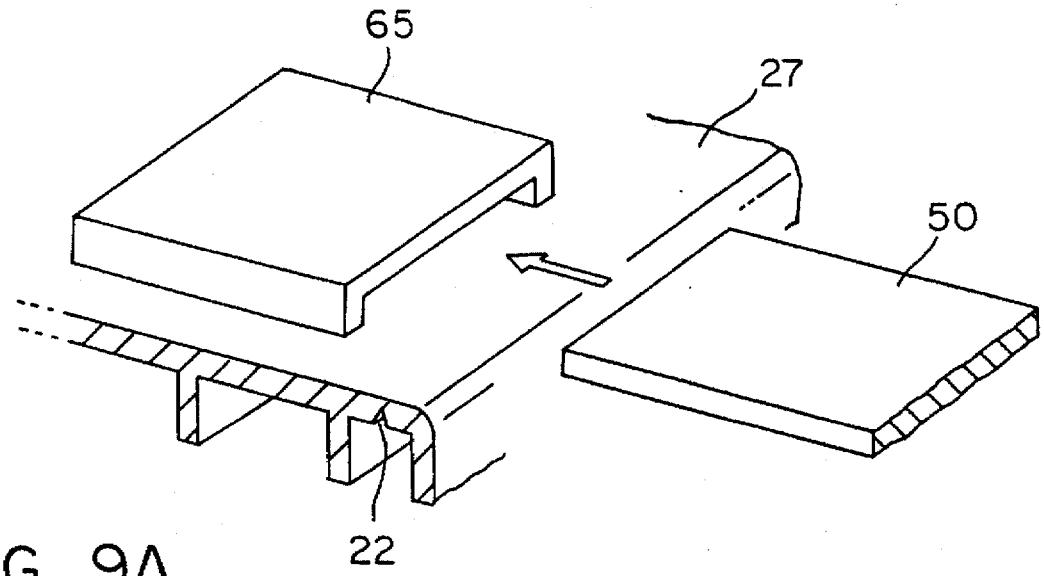
FIG. 9A is a perspective view showing an alternative manner in which the elastic strip is fixed to the stationary lid member.
Figure 9B:
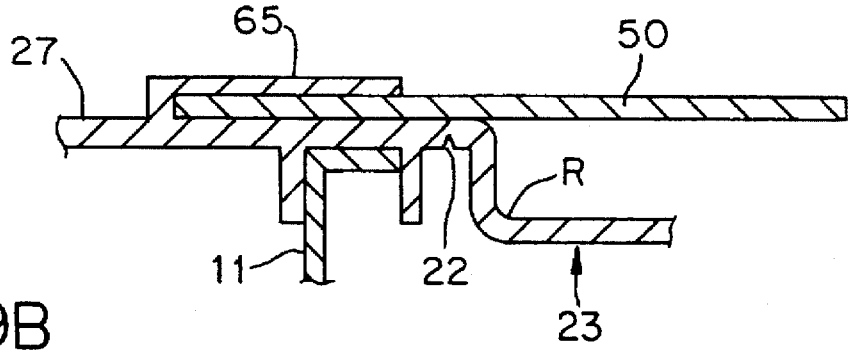
FIG. 9B is a sectional side view showing the elastic strip of FIG. 9A as it has been fixed to the stationary lid member.

FIG. 9 shows still another embodiment of the elastic strip 50, in which the second upper surface region 27 of the stationary lid member 21 is formed with a covering strip 65 defining a channel between the covering plate 65 and the second upper surface region 27 so that one end of the elastic strip 50 is fixedly inserted into the channel. Alternatively, the elastic strip 50 may be insertion-molded simultaneously with molding of the stationary lid member 21 so that the elastic strip 50 may be fixed in the channel.

Figure 10A:
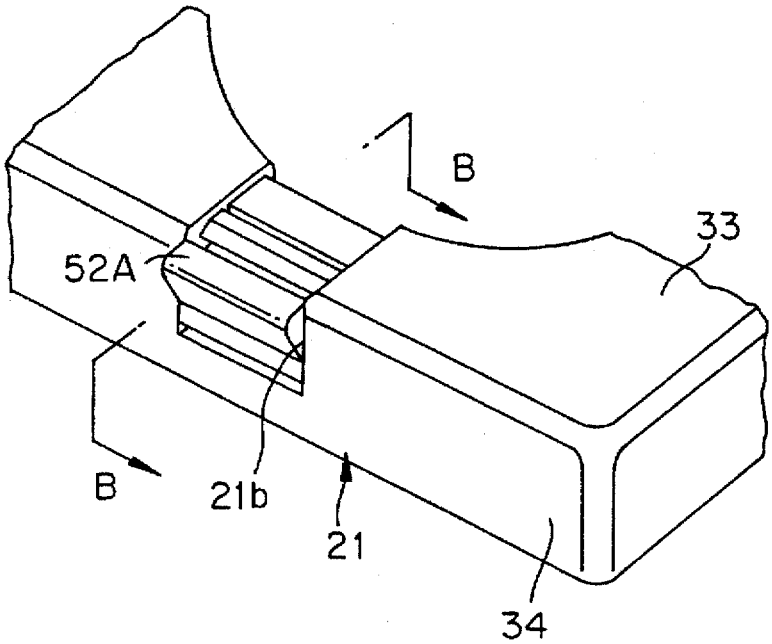
FIG. 10A is a perspective view exemplarily showing a depressor means used to lock or unlock the movable lid member relative to the stationary lid member.
Figure 10B:
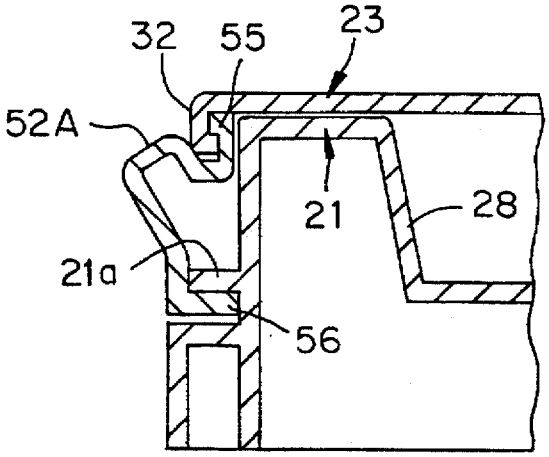
FIG. 10B is a sectional view taken along a line B—B in FIG. 10A.
Figure 10C:
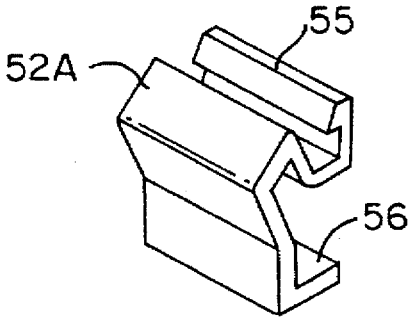
FIG. 10C is a perspective view of a depressor member.

FIG. 10 Shows an alternative embodiment of the depressor means 52 which may be operated by a user's finger to open or close the movable lid member 23, in which the depressor member 52A is formed from an elastically deformable synthetic resin material separately of the stationary lid member 21 while the movable lid member 23 partially extends outward beyond the first peripheral edge 28 of the stationary lid member 21 to an outer side surface of the stationary lid member 21. This extension and the depressor member 52A are received in a recess 21*b* formed to extend from the first upper surface region 33 to an outer surface of the outer locking periphery 34. The depressor member 52A includes a locking projection 55 destined to be engaged with a clocking projection 32 of the movable lid member 23 and a leg portion 56 undetachably fixed by a retainer projection 21*a* formed on the outer surface of the stationary lid member 21. This depressor member 52A is elastically deformed as it is depressed by a user's finger and thereupon the engagement is released.

Figure 11A:
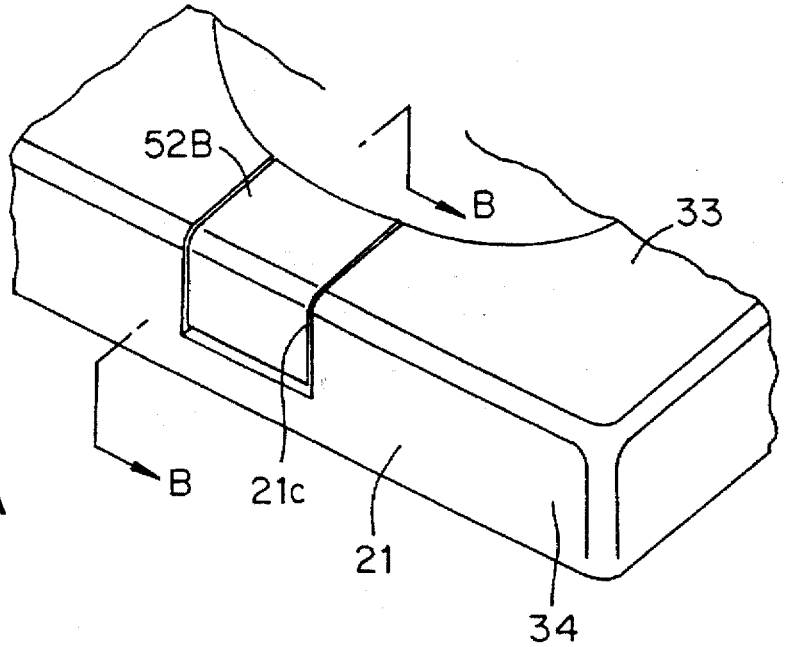
FIG. 11A is a perspective view showing an alternative embodiment of the depressor means.
Figure 11B:
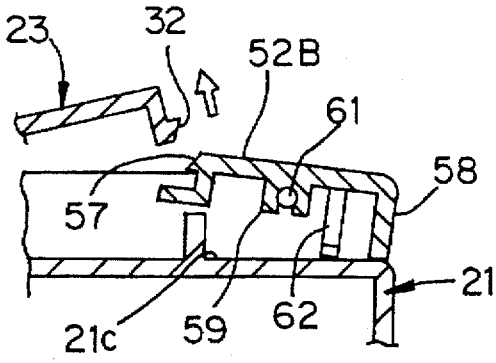
FIG. 11B is a sectional view taken along a line B—B in FIG. 11A, showing a manner in which the movable lid member is opened by operating the depressor member.
Figure 11C:
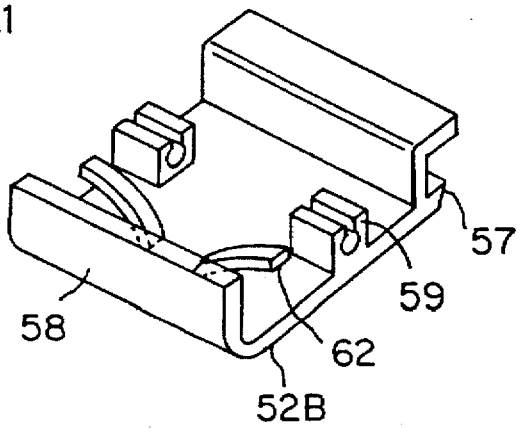
FIG. 11C is a perspective view showing an inside of the depressor member.
Figure 12A:
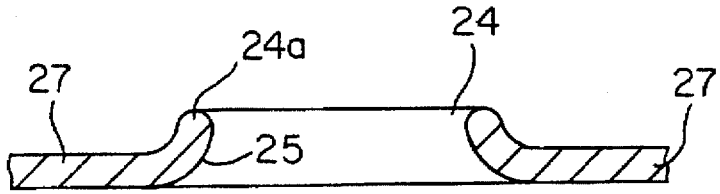
FIGS. 12A through 12G are sectional views showing various sectional configurations possibly presented by an opening of the stationary lid member through which the wetted tissues are successively picked out from a stack thereof packed in the container.
Figure 12B:
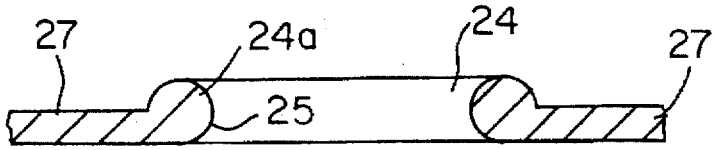
Figure 12C:
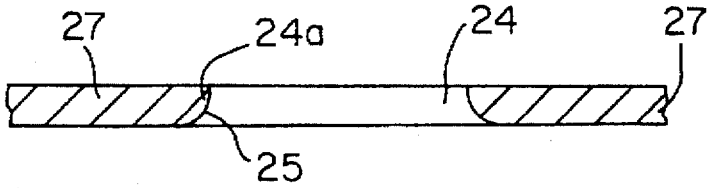
Figure 12D:
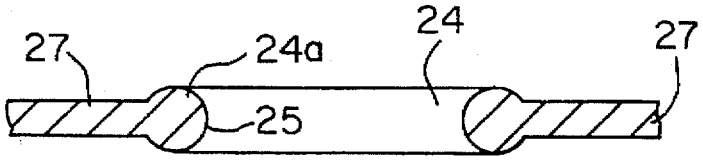
Figure 12E:
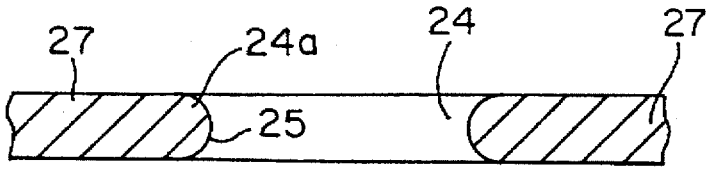
Figure 12F:
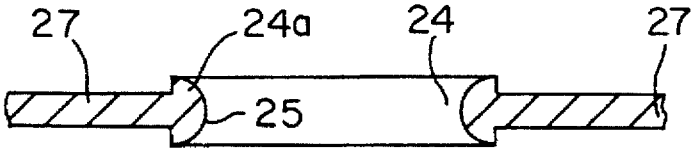
Figure 12G:
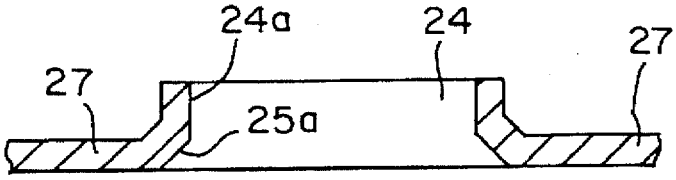
Figure 13A:
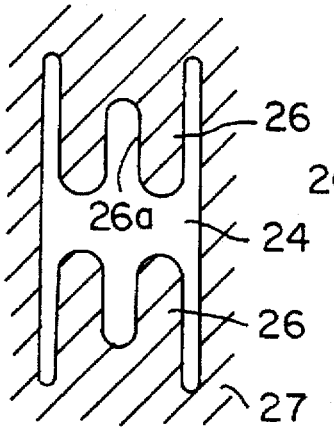
FIGS. 13A through 13H are plan views showing various plane configurations possibly presented by the opening.
Figure 13B:
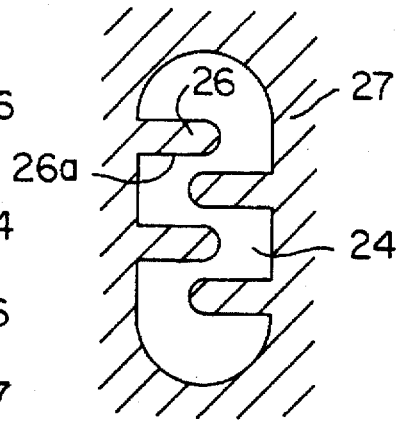
Figure 13C:
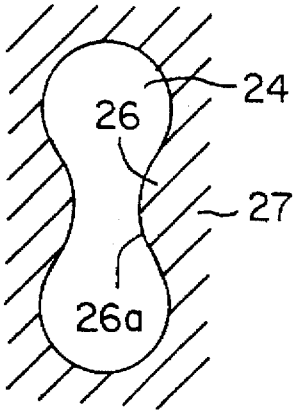
Figure 13D:
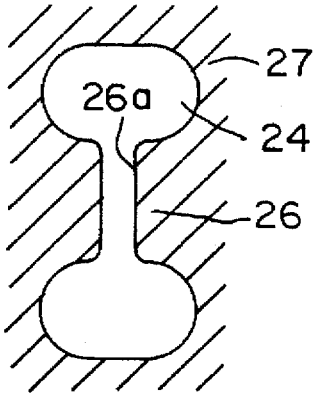
Figure 13E:
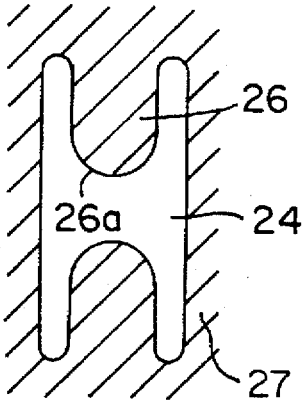
Figure 13F:
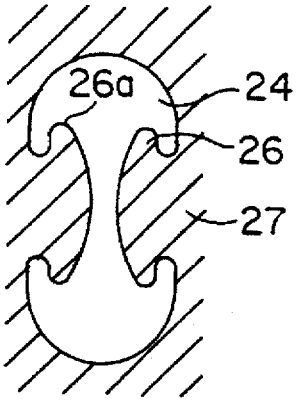
Figure 13G:
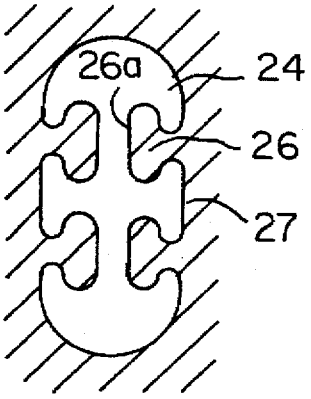
Figure 13H:
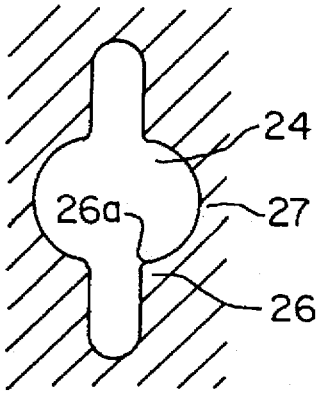

FIG. 11 shows still another embodiment of the depressor means 52 which may be operated by a user's finger to open or close the movable lid member 23, in which a depressor member 52B is molded from a suitable synthetic resin material separately of the stationary lid member 21 and received in the recess 21*c* formed to extend from the first upper surface region 33 to the outer surface of the outer locking periphery 34. The depressor member 52B includes a locking projection 57 destined to be engaged with the locking projection 32, a leg portion 58 bearing against the recessed surface 21*c*, a bearing 59 supported by a pivot pin 61 extending across the recess 21*c* and leaf springs 62 pressed against inner surface of the recess 21*c*.

As the movable lid member 23 is closed by a user's depressing operation, the depressor member 52B is counterclockwise rotated, causing the locking projection 32 to clear the locking projection 57 and then to engage the latter from below, whereupon the depressor member 52B is forcibly pivoted counterclockwise and the leaf springs 62 are depressed with the leg portion 58 being slightly lifted off from the recessed surface 21*c*. The depressor member 52B is clockwise pivoted as it is depressed by a user's finger against the elastic force of the leaf springs 62, and consequently said engagement is released. As will be apparent from this embodiment, the herein used term "elastic deformation of the depressor means" should be understood to include, in addition to elastic deformation occurring in the depressor means or depressor member itself, change in its posture under the effect of the leaf springs operatively associated with the depressor means or depressor member.

FIG. 12 shows various sectional configurations possibly presented by the opening 24 through which the wetted tissues will be successively picked out. Referring to FIG. 12A, the peripheral edge 24*a* defining the opening 24 has its inner surface 25 which presents a circular arc as viewed in its sectional view and its radius is at least of 1 mm, preferably of 2 to 10 mm or may gradually vary. Such sectional configuration allows the wetted tissues to be smoothly picked out through the opening 24 along the inner peripheral surface 25 thereof. The openings 24 having the other sectional configurations shown by FIGS. 12B through 12G can be also useful for implementation of the invention. For example, the inner peripheral surface 25*a* of the opening 24 shown by FIG. 12G presents a flat slope instead of the circular arc as viewed in its sectional view, but such a configuration is also acceptable for the invention.

FIG. 13 shows various plane configurations possibly presented by the opening 24. While the specific embodiment shown by FIG. 1 adopts the opening 24 having an elliptical plane configuration, those shown by FIGS. 13A through 13H may be also employed in implementation of the invention. These configurations are characterized by that a plurality of tongue portions 26 extend into the opening 24 and the peripheral edge 24*a* of the opening 24 is partially formed by respective edges 26*a* of these tongue portions 26.

FIGS. 14 through 20 show a particularly preferred embodiment of the invention. It should be understood that the parts similar to those in the embodiment shown by FIGS. 1 through 13 are designated by similar reference numerals and description thereof will be simplified in order to minimize repetition of description.

According to this embodiment, the stationary lid member 21 and the movable lid member 23 are molded separately of each other. The stationary lid member 21 includes the first upper surface region 33 of whose outer border extends above the entire outer locking periphery 34 of the lid 21, the second upper surface region 27 and a third upper surface region 27*a* defined by a peripheral edge 86 between the second upper surface region 27 and the opening 24 at a level lower than the second upper surface region 27. The stationary lid member 21 further includes a first recess 75 formed in the second upper surface region 27 at a transverse middle of the stationary lid member 21 between the rear edge 34*a* and a portion of the peripheral edge 86 opposed to the rear edge 34*a*, a second recess 78 which is larger than the recess 75 and defined between this recess 75 and the peripheral edge 86, a locking projection 79 formed on the peripheral edge 28 at a location opposed to the locking projection 32 and destined to be engaged with the locking projection 32, and a depressor means 80 provided in the form of a recess in the first upper surface region 33 adjacent the locking projection 79. A portion of the peripheral edge 28 in the proximity of the locking projection 79 as well as the depressor means 80 are formed to be thinner than the rest of the peripheral edge 28 and the first upper surface region 33 so that their elastic deformation may be facilitated. The movable lid member 23 additionally includes a peripheral edge 23*a* projecting toward the second upper surface region 27 so as to be closely engaged with the entire peripheral edge 28, an annular wall 85 projecting from the inner surface of the movable lid member 23 so as to be closely engaged with the peripheral edge 86, and a retainer means 76 serving to retain one end of the elastic strip 50. A region 32*a* surrounding the locking projection 32 is formed to be thinner than the peripheral edge 23*a* in order to facilitate a desired elastic deformation. The movable lid member 23 constructed as described above is hinged to the stationary lid member 21 by a means of pins 77*a* formed by projections 77 on the rear edge of the movable lid member 23 rotatably supported by bearings 77*b* formed on the inner edge of the first upper surface region 33 adjacent the rear edge 34*a* of the stationary lid member 21.

As will be apparent from FIGS. 17, 20, 21 and 22, the retainer means 76 is located at a predetermined distance from the rear edge toward the front edge of the movable lid member 23 and comprises a covering plate 76*a* provided at a predetermined distance from the rear edge toward the annular wall 85 of the movable lid member 23, a projection 76*b* provided on the inner surface of the covering plate 76*a* along its transversely middle line, opposite side walls 76*c* extending longitudinally of the movable lid member 23, a cylindrical projection 81 extending from the inner surface of the movable lid member 23 and fitting on the projection 76*b* so as to define a retaining pin, and opposite side walls 82 projecting from the inner surface of the movable lid member 23 so as to be closely engaged with respective inner surfaces of the opposite side walls 76*c*. The elastic strip 50 has its one end inserted into the retainer means 76 with an opening 50*a* formed in the one end fitting on the cylindrical projection 81 and its free end 50*b* inserted into the first recess 75 of the stationary lid member 21. The elastic strip 50 is demensioned so that an intermediate portion 50*c* extending between the opening 50*a* and the free end 50*b* may be slightly curved in such inserted state (FIG. 14) and, after the movable lid member 23 has been closed, the elastic strip 50 is charged with an elastic energy by being curved in generally Ω-shape away from the hinged portion between the stationary lid member 21 and the rear edge of the movable lid member 23 with the intermediate portion 50*c* being smoothly received by the second recess 78.

Figure 14:
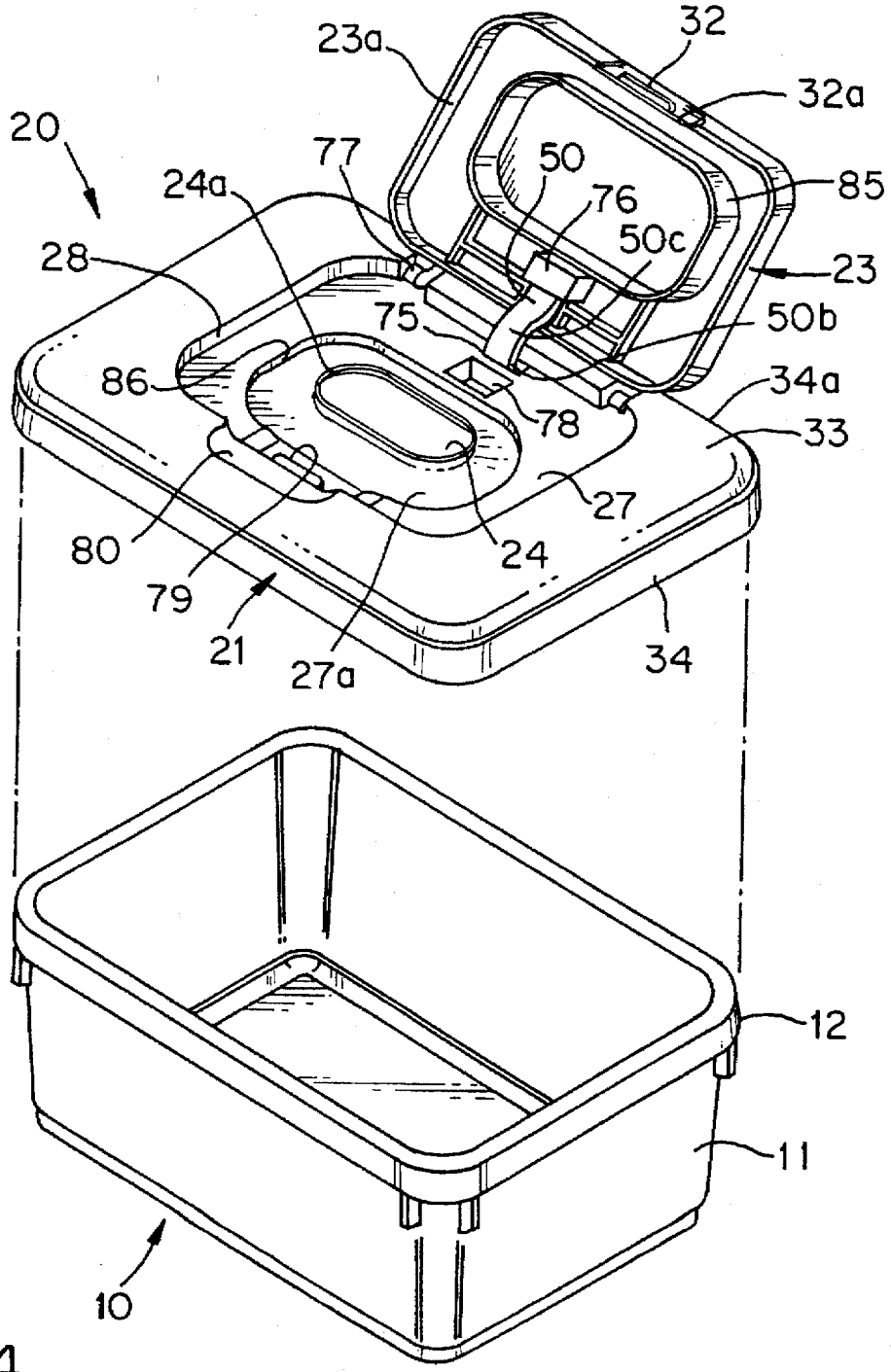
FIG. 14 is a perspective view shown an alternative embodiment of the inventive container as its lid being separated from its body and the movable lid member forming a part of the lid being opened.
Figure 15:
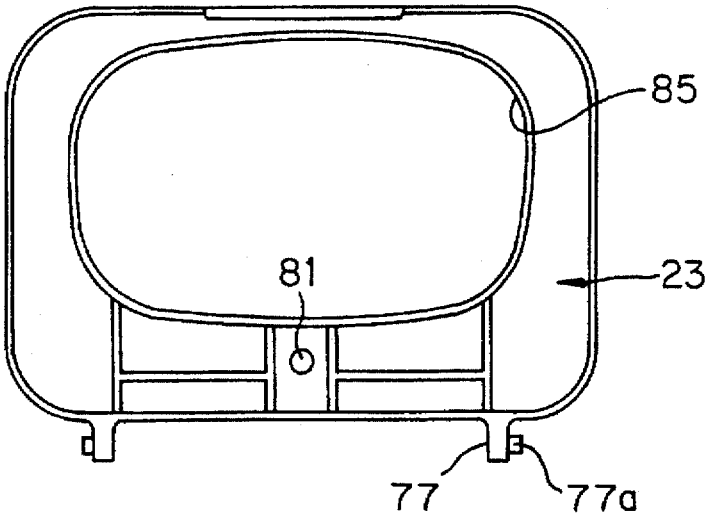
FIG. 15 is a plan view showing the inside of the movable lid member in the embodiment shown by FIG. 14.
Figure 16:
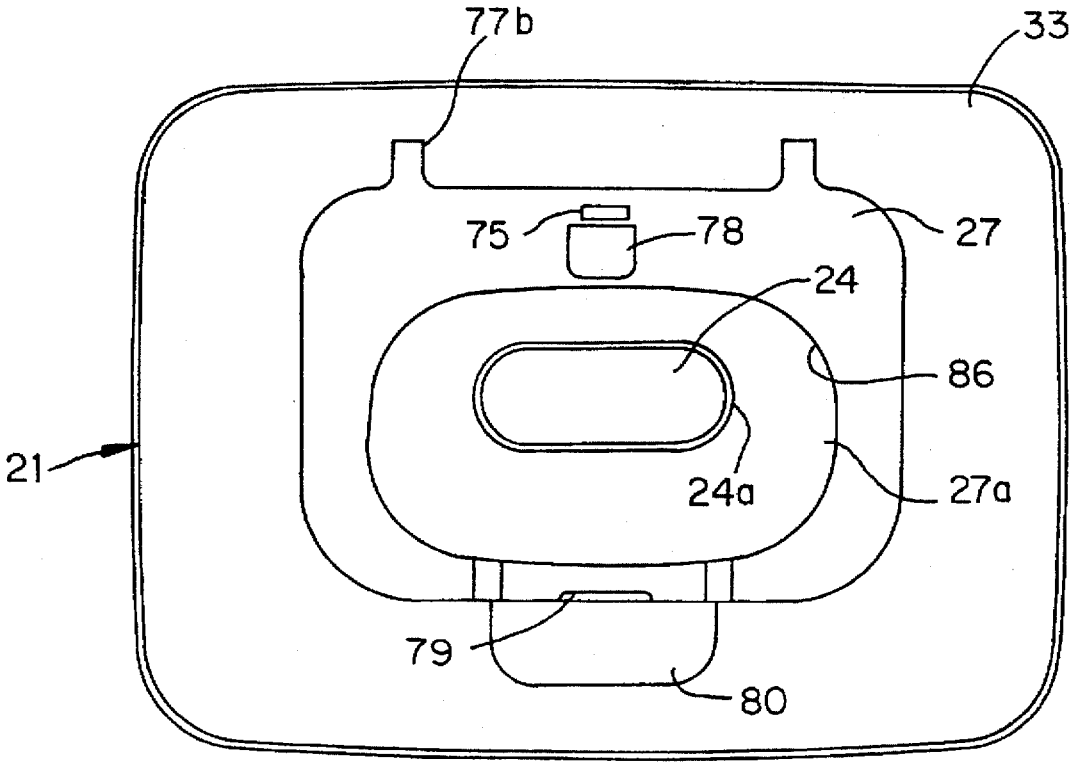
FIG. 16 is a plan view showing an upper surface of the stationary lid member in the embodiment shown by FIG. 14.
Figure 17:
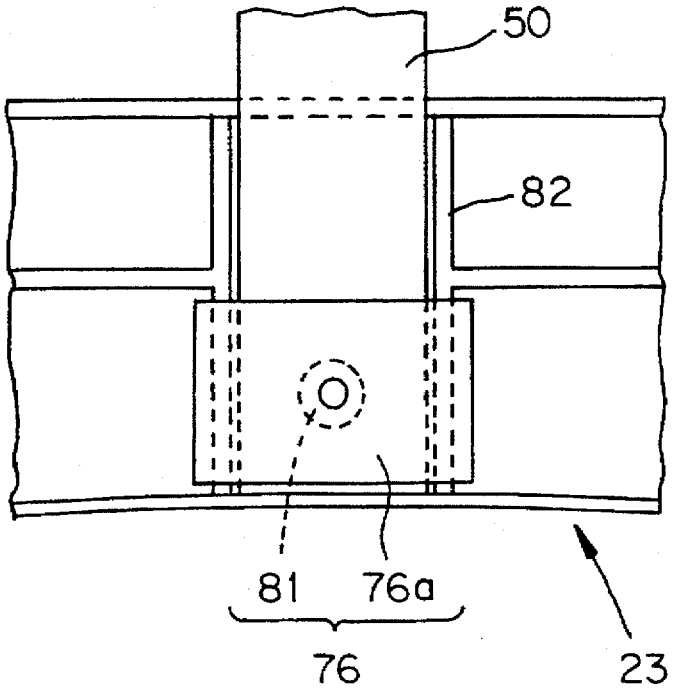
FIG. 17 is a plan view shown a portion of the elastic strip fixed to the stationary lid member in the embodiment shown by FIG. 14.
Figure 18:
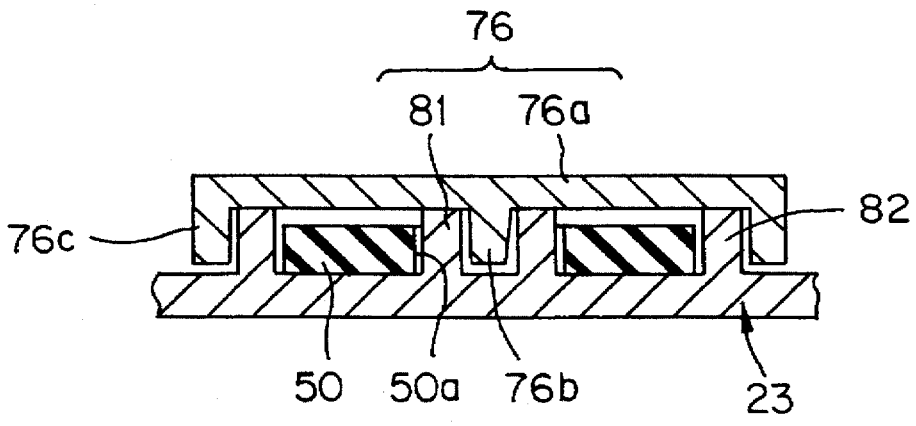
FIG. 18 is a sectional view of the portion shown by FIG. 17.
Figure 19:
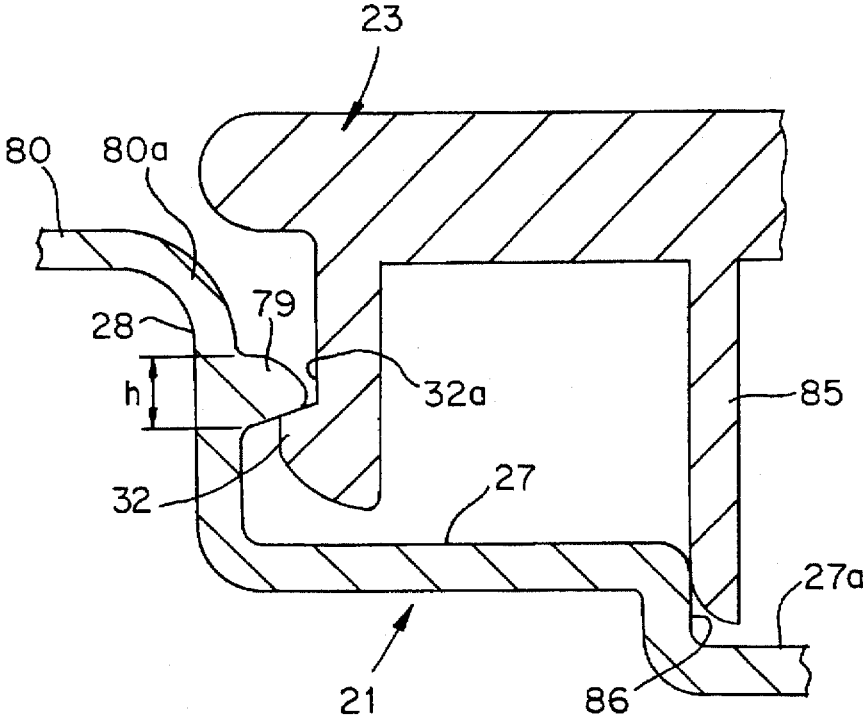
FIG. 19 is a sectional view showing, in an enlarged scale, an alternative embodiment of the mechanism for locking the movable lid member and the stationary lid member together.
Figure 20:
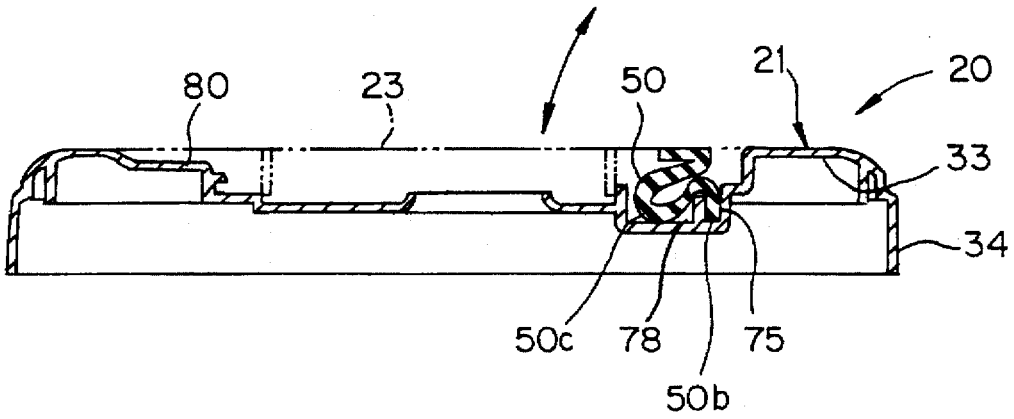
FIG. 20 is a sectional view showing the elastic strip curved after the movable lid member has been closed in the embodiment shown by FIG. 14.

Referring to FIGS. 14 and 19, the locking projection 32 of the movable lid member 23 clears the locking projection 79 of the stationary lid member 21 and engages the latter from below as the movable lid member 23 is closed by a user's finger, during which the region in the proximity of the locking projection 32 as well as the region in the proximity of the locking projection 79 are elastically deformed to facilitate the locking projection 32 to clear the locking projection 79 and, after such clearing has been completed, those regions elastically restore their original states so as to make the engagement reliable. Upon depression of the depressor means 80 by a user's finger, the locking projection 79 clears the locking projection 32 from above and thereby the engagement is released. Clearing for such release is also facilitated by the elastic deformation.

Referring to FIG. 19, engagement as well as disengagement of the locking projections 32, 79 can be facilitated by dimensioning the locking projection 79 to have a height of approximately 1.0 mm and configurating their surfaces along which they are slidably moved to present circular arcs or slopes. Engagement as well as disengagement assisted with elastic deformation and restoration occurring in the intermediate portion 80*a* extending between the locking projection 79 and the depressor means 80 can be further easily and reliably achieved by forming the intermediate portion 80*a* to present a curvature defined by a radius of approximately 1.2 mm. Also in the embodiment shown by FIG. 14, those two locking projections can be smoothly engaged with and disengaged from each other, since the stationary lid member 21 is molded from the synthetic resin material which is elastically deformed more easily than the synthetic resin material from which the movable lid member 23 is molded.

Figure 21A:
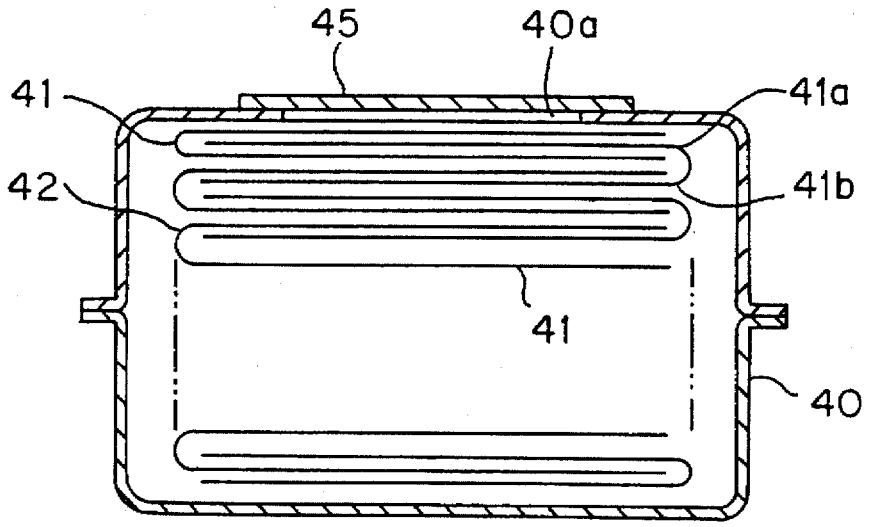
FIG. 21A is a sectional view showing a manner in which the wetted tissues are folded and stacked within a sealed bag.
Figure 21B:
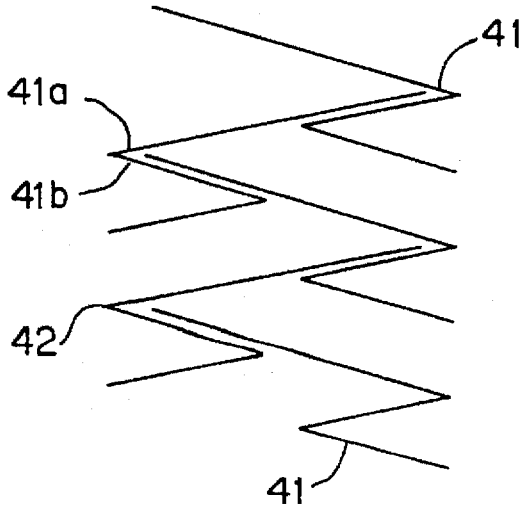
FIG. 21B is a schematic diagram illustrating an alternative manner in which the wetted tissues are folded and stacked.

Referring to FIG. 21A, a stack of wetted tissues 41 is packed in a sealed bag 40 made of a soft synthetic resin sheet. Each of wetted tissues 41 is folded along a folding line 42 generally in two. Each of wetted tissues 41 thus folded in two has its lower half 41*b* inserted between an upper half 41*a* of the underlying one of wetted tissues 41 and an upper half 41*a* of the next underlying one of wetted tissues 41. In this manner, the lower half 41*b* of the sheet picked out by a user from the stack of wetted tissues 41 pulls up the upper half 41*a* of the underlying one of wetted tissues 41. The wetted tissues 41 may be folded and stacked in any manner so far as they can be picked out one by one, for example, in a manner as shown by FIG. 21B. The sealed bag 40 is formed in its top with an opening 40*a* through which the wetted tissues are picked out one by one and this opening 40*a* is sealed with a cover sheet 45 destined to be separated from the bag 40 in actual use thereof. Wetted tissues are made of fibrous materials such as nonwoven fabric, paper or gauze or foamed sheet and immersed with skin lotion, milky lotion and/or the other humectant containing germicide, sterilizer, detergent or the like.

Wetted tissues 41 thus stacked within the sealed bag 40 are packed into the container body 11 with the opening 40*a* of the bag 40 being opened by separating the cover sheet 45 so that one end of the uppermost sheet of wetted tissues 41 can be picked out through the opening 24 of the stationary lid member 21. With the movable lid member 23 being closed, the one end of the uppermost one of wetted tissues 41 is exposed out of the opening 24 but there is no apprehension that the uppermost one of wetted tissues 41 might be contaminated or dried from its exposed end since, for example, in the container 10 according to the embodiment shown by FIG. 1, such end of the uppermost one of wetted tissues 41 is protected within a space defined by the annular walls 29, 35 fitting on each other.

What is claimed is:

1. A container for wetted tissues comprising a container body, a stationary lid member and a movable lid member each molded from a suitable synthetic resin material; wherein:

said body has a first opening on an upper side thereof through which a stack of wetted tissues is packed thereinto;

said stationary lid member includes an outer locking periphery adapted for detachably and sealably fitting on said first opening, a first upper surface region defined by said outer locking periphery and a first peripheral edge having spaced apart front and rear edges, a second upper surface region defined by said first peripheral edge, and a second opening formed in said second upper surface region substantially at a central zone thereof through which wetted tissues are picked out;

said movable lid member includes a second peripheral edge projecting from an inner surface thereof so as to fit on said first peripheral edge thereby to define a space between said second upper surface region of said stationary lid and said inner surface of said movable lid member, having spaced apart front and rear edges and being hinged to said stationary lid member adjacent said rear edge;

an elastic strip made of a nonmetallic material normally biasing said movable lid member to be opened extends across said rear edges of said stationary and movable lid members and held between said second upper surface region and said inner surface of said movable lid member wherein said elastic strip is at least partially curved generally in a U-shape or Ω-shape and charged with an elastic energy within said space as said movable lid member is closed;

at least one of said front edges of said stationary and movable lid members opposed to each other upon closure of said movable lid member includes a locking projection adapted to be detachably engaged with the other; and said first upper surface region is provided adjacent said locking projection with an elastically deformable depressor means serving to release said engagement of said locking projection.

2. A container according to claim 1, wherein said stationary lid member is made of a material having an elastical deformability higher than the material for said movable lid member.

3. A container according to claim 1, wherein at least one of said depressor means and a region in the proximity of said depressor means are formed so as to be elastically deformed more easily than the rest of said stationary lid member.

4. A container according to claim 1, wherein said elastic strip has an end fixed to one of said stationary lid member and movable lid member and said end is at a predetermined distance from said hinged portion toward said front edge of said lid member to which said end is fixed.

5. A container according to claim 4, wherein said fixed end of said elastic strip is fixed by a retainer means comprising a covering plate provided integrally with said lid member so as to cover said fixed end, a projection provided between said covering plate and said lid member, and an opening formed in said fixed end so as to receive said projection.

6. A container according to claim 5, wherein said elastic strip is formed to be elongate and having said fixed end and a free end longitudinally opposite to each other so that said fixed end is fixed to an inner surface of said movable lid member while said free end bears against said second upper surface region without being fixed thereto.

7. A container according to claim 6, wherein said second upper surface region is provided on a position at which said free end of said elastic strip bears against said second upper surface region with a first recess serving to receive and support said free end and between said first recess and said second opening with a second recess serving to receive a longitudinally intermediate curved portion of said elastic strip as said movable lid member is closed.

8. A container according to claim 1, wherein said second upper surface region is lowered than said first upper surface region and formed substantially in a central zone thereof with a third upper surface region defined by a third peripheral edge, said third upper surface region being lower than said second upper surface region, and said third upper surface region is provided substantially in a central zone thereof with said second opening.

9. A container according to claim 8, wherein said movable lid member is formed on an inner surface thereof with an annular wall adapted to fit on said third peripheral edge.

10. A container according to claim 3, wherein said portions formed to be elastically deformed more easily than the rest is formed to be thinner than at least the rest of said stationary lid member.

11. A container according to claim 1, wherein said movable lid member is provided on the front edge thereof with said locking projection as a first locking projection while said stationary lid member is formed on the front edge thereof with a second locking projection adapted to be disengaged under said elastic deformation.

12. A container according to claim 11, wherein said depressor means is molded as a depressor member separately of said stationary lid member wherein said depressor member is supported by said stationary lid member and formed on a free end thereof with said second locking projection.

13. A container according to claim 1, wherein said elastic strip is selectively made from any one of rubber and synthetic resin materials.

* * * * *

UNITED STATES PATENT AND TRADEMARK OFFICE

CERTIFICATE OF CORRECTION

PATENT NO. : 5,699,912

DATED : December 23, 1997

INVENTOR(S) : H. ISHIKAWA ET AL.

It is certified that error appears in the above-indentified patent and that said Letters Patent is hereby corrected as shown below:

On the title page, item [73], Assignee, Change "Uni-Charm Corporation, Ehime-ken, Japan" to ---Uni-Charm Corporation, Ehime-ken, Japan and Dai Nippon Printing Company, Ltd., Tokyo, Japan---.

Signed and Sealed this

Thirteenth Day of July, 1999

*Attest:*

*Attesting Officer*

Q. TODD DICKINSON

*Acting Commissioner of Patents and Trademarks*